United States Patent [19]

Zinevich et al.

[11] 4,138,206

[45] Feb. 6, 1979

[54] GEAR-TYPE POSITIVE-DISPLACEMENT MACHINE

[76] Inventors: Vladimir D. Zinevich, ulitsa Schorsa, 4, kv. 11; Georgy Z. Yarmolenko, ulitsa 50 let USSR, 16a, kv. 44; Vladimir S. Sinyavsky, ulitsa Shevchenko, 93/1, kv. 7, all of Chernigov; Nikolai T. Romanenko, Tokmakov pereulok, 13-15, kv. 165; Jury F. Nikitin, Arbat, 18/1, kv. 31, both of Moscow, all of U.S.S.R.

[21] Appl. No.: 713,218

[22] Filed: Aug. 9, 1976

Related U.S. Application Data

[63] Continuation of Ser. No. 471,056, May 17, 1974, abandoned.

[51] Int. Cl.[2] ..... F01C 1/14; F01C 5/02; F01C 9/00

[52] U.S. Cl. ..... 418/153; 418/165; 418/196; 92/67; 92/120

[58] Field of Search ..... 418/153, 164–166, 418/196; 417/481; 92/67, 120; 73/252

[56] References Cited

U.S. PATENT DOCUMENTS

| | | | |
|---|---|---|---|
| 1,042,883 | 10/1912 | Brown | 92/120 |
| 2,095,404 | 10/1937 | Wurr | 92/120 |
| 3,017,807 | 1/1962 | Grover | 92/120 |
| 3,203,356 | 8/1965 | Jepsen | 418/153 |
| 3,528,345 | 9/1970 | Rumsey | 418/196 |
| 3,870,437 | 3/1975 | Gondek | 418/153 |

FOREIGN PATENT DOCUMENTS

| | | | |
|---|---|---|---|
| 2015654 | 10/1971 | Fed. Rep. of Germany | 418/196 |
| 261853 | 5/1970 | U.S.S.R. | 418/196 |

*Primary Examiner*—John J. Vrablik
*Attorney, Agent, or Firm*—J. Harold Nissen

[57] ABSTRACT

A gear-type machine whose housing accommodates two symmetrical idle gears which are in mesh with an internal toothing of an element embracing them inside the housing and with an external toothing of a central gear, whereas the spaces confined between the idle gears and the toothings accommodate webs to form herewith fluid tight chambers for a working fluid which thus imparts rotation of the idle gears. The internal toothing is stationary and carries the webs, while the idle gears are free to roll over the stationary toothing to impart rotation to the central gear which, in turn, may transmit the torque to a machine output member. In another, preferred embodiment, the central gear is stationary while the housing with its internal toothing is rotatable and constitutes the output.

The inventive machine enables rotation of the output member through an angle smaller or greater than 360°.

13 Claims, 4 Drawing Figures

GEAR-TYPE POSITIVE-DISPLACEMENT MACHINE

This is a continuation, of application Ser. No. 471,056 filed May 17, 1974, now abandoned.

The present invention relates to gear-type positive displacement machines, wherein used as a working fluid is either a liquid or a gas.

Gear-type machines, embodied according to the present invention, may be either motors or pumps used for driving the mechanisms of drill-rig actuators, shaft loading machines, clamping devices, pipe fittings, steering controls control of transport vehicles, and the like.

Known in the prior art are gear-type positive displacement machines incorporating housings closed by covers with sealing disks. Accommodated within the housing interior is an element with internal toothing and a gear with external toothing set coaxially to said element and fixed in position on the shaft which is mounted within the housing. Both the gear and the internal-toothing element are rotatably mounted inside the housing located inside the annular space confined within the toothings of the gear and of the element are idle gears set on dead axles held to the housing covers. The above-mentioned idle gears are in mesh both with the external toothing of the gear and with the internal toothing of the element.

Provided inside the space confined within the two adjacent idle gears and the toothings of the gear and of the element are webs adapted to form fluid-tight chambers. The webs are rigidly mounted within the sealing disks and are provided with a system of passageways to supply the working fluid to or let it out from said passageways.

The above described gear-type machine is adapted to rotate an actuator within unlimited rotational angles. The useful space of the fluid-tight chambers, dependent upon the tooth space of the gear toothings, is relatively small and cannot be used to good advantage for an actuator to turn through a limited angle of rotation, since when the machine is reversed, the dead space is considerably larger than the useful space of the fluid-tight chambers. This results in an increased rate of fluid flow per unit power.

Moreover, widely known are vane-type machines used when a limited angle of rotation of an actuator is required. The above-mentioned machines incorporate a stator and a rotor with the vanes fastened thereon. The principal disadvantage of the vane-type machines resides in considerable losses due to friction of the rotor vanes as well as due to leakage of the fluid along the vane circumference.

It is a specific object of the present invention to provide a reversible gear-type machine, capable of rotating the actuator through an angle less or greater than 360°.

It is another object of the present invention to provide a gear-type machine wherein the useful space of the fluid-tight chambers is considerably greater than the tooth space.

According to these and other general objects, a gear-type machine is proposed whose housing accommodates rotatable idle gears spaced apart and meshed both with the internal toothing of the element embracing the idle gears and with the external toothing of the central gear coaxially set in said element, whereas in the spaces confined within the adjacent planetary gears and the toothings webs are provided to form fluid-tight chambers into which is fed and wherefrom is let out the working fluid which imparts rotation to the idle gears for the maching output member to be driven. According to the invention one of to toothings is provided with webs and is fixed in a stationary position, whereas the idle gears are free to roll over the stationary toothing so as to impart rotation to the other toothing which, in turn, transmits the torque to the output member of the machine.

It is proposed in a first embodiment that the internal-toothing embracing the idle gears be in meshing connection with webs and be fixed in the stationary position, whereas the central gear is used as the output member of the machine.

Such an embodiment ensures a most simple and convenient-to-use construction of the gear-type positive-displacement machine.

It is also suggested, in a preferred second embodiment, that the central gear be provided with webs and be fixed in a stationary position, whereas the internally toothed element is used as the output member.

Such an embodiment of the gear-type positive-displacement machine provides for an increased length of the packing surface along the arc between the web and the internal toothing of the element embracing the idle gears, which adds to the volumetric efficiency of the machine. Besides, such an embodiment of a gear-type positive-displacement machine makes it applicable as compact positioners and as other servo actuators used in automatic control and regulation systems.

It is of advantage that the surface of each web facing the idle gear be in fact a portion of a cylindrical surface with a radius approximating that of the addendum circle of the idle gears, with the result that the fluid-tight chambers have a minimum possible dead space.

Gear-type positive-displacement machines, carried into effect according to the present invention, can be used as motors or pumps and ensure rotation of the output (driven) member engaged with the actuator of various devices, say, drill rigs, loading machinery, steering controls of transport vehicles, through an angle less or greater than 360° C.

Besides, the useful space of the above-mentioned gear-type positive-displacement machine is much greater than that of conventional gear-type positive-displacement machines as accounted for by the tooth spaces thereof, which enables a high torque for motors and a relatively high delivery rate for pumps at minimum mechanical losses.

Other objects and advantages of the herein-proposed gear-type positive-displacement machine will be more apparent from a consideration of specific embodiments of the present invention, with reference to the accompanying drawings, wherein.

Figure 2:
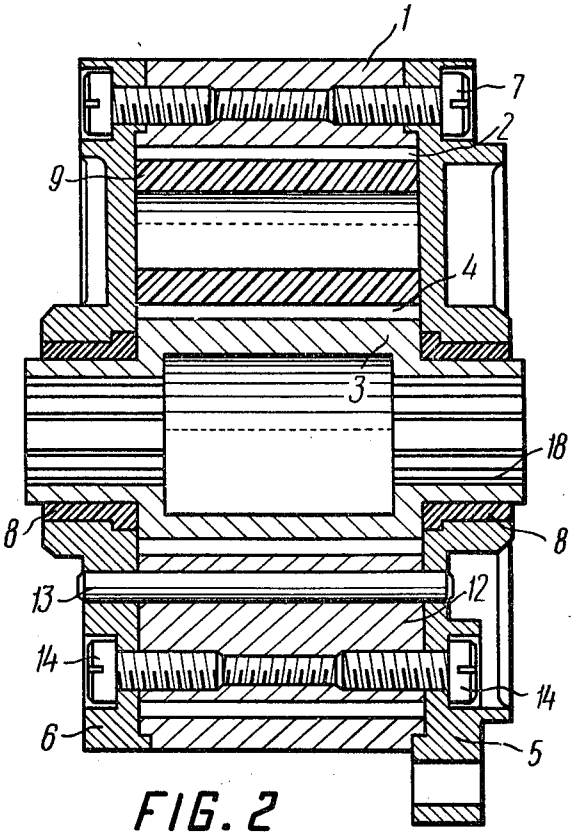
FIG. 2 is a section taken along the line II—II in FIG. 1.
Figure 1:
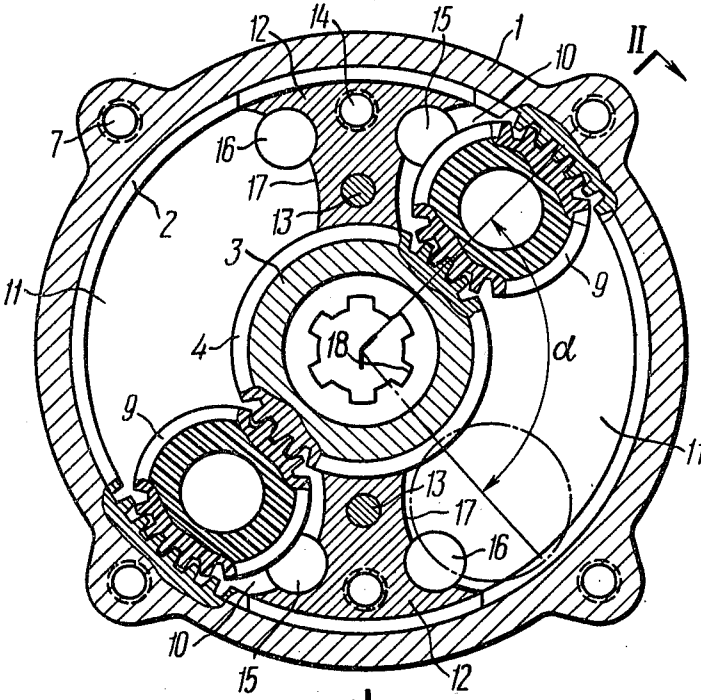
FIG. 1 is a cross-sectional view of an exemplary embodiment of a gear-type positive-displacement machine according to the invention.

The first embodiment of gear-type positive-displacement machine incorporates a stationary housing 1 (FIG. 1) which simultaneously serves as the element with an internal toothing 2. Located inside the housing 1 coaxially to the toothing 2, is a central gear 3 provided with an external toothing 4. The housing 1 is closed at both ends by covers 5 (FIG. 2) and 6. The above-mentioned covers are held to the housing 1 by bolts 7. The gear 3 with its journals rests upon sliding bearings 8. As bearings, use may also be made of antifriction bearings or of any other means suitable for the purpose.

Located in the annular space formed by the toothing 2 and 4, are two idle gears 9 arranged diametrically and meshed with said toothings. The housing 1 with the toothing 2 is fixed stationary in position and the idle gears 9 roll over said toothing, thereby rotating the gear 3.

To form fluid-tight chambers 10 and 11 each space confined within the idle gears 9 and the toothing 2 and 4, has webs 12. It can be clearly seen from the drawing that this arrangement provides sealing means, or means to make the chambers 10, 11 fluid-tight, constituted by portions of the internally toothed element 2 and peripheral portions of the webs 12.

Figure 3:
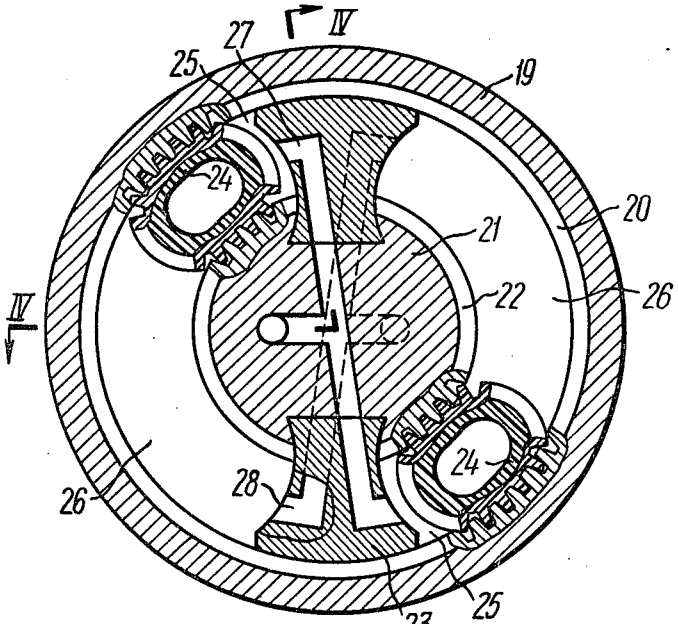
FIG. 3 is a cross-sectional view of another, preferred embodiment of a gear-type positive-displacement machine, according to the invention.

The web 12 on the sides adjacent to the toothing 2 are provided with peripheral portions having one or more teeth for engaging the toothing 2, thereby making the chambers 10 and 11 fluid-tight. It will be noted that FIGS. 1 and 3 do not show all rows of teeth, such as at the portions 2 and 4, and at the outer peripheries of the webs 12 where they engage the internal toothing 2 that is rigid with the housing 1. The stationary fixed position of the webs 12 with respect to the housing 1 is due to the use of locating pins 13 and bolts 14 which run through the covers 5 and 6.

The fluid-tight chambers 10 and 11 communicate through passageways 15 (FIG. 1) and 16, respectively, with the sources (not shown) of high- and low-pressure working fluid. As a working fluid, use may be made of a liquid or a gas.

To reduce the dead space of the fluid-tight chambers and consequently to increase the useful space thereof, surfaces 17 of the webs 12 facing the idle gears 9 are in fact portions of a cylindrical surface with a radius approximating that of the addendum circle of the idle gears 9.

The gear 3 serves as the output member of the gear-type machine and is provided with splines to be joined with a shaft (not shown) of a servo actuator.

Referring to the other embodiment of the herein-proposed gear-type positive-displacement machine, which is preferable to the first one a rotatable housing 19 (FIG. 3) serves simultaneously as an element with an internal toothing 20. Coaxially to said toothing is arranged a stationary central gear 21 with an external toothing 22. The gear 21 is fixed in a stationary position, whereas the housing 19 is rotatable and serves as the output member of the gear-type positive-displacement machine.

Webs 23 are dovetailed to the gear 21. In each space confined within idle gears 24 and the toothings 20 and 22, the web walls form fluid-tight chambers 25 and 26, including the earlier mentioned means to make the two chambers fluid-tight, thereby increasing the volumetric efficiency of the gear-type machine, as has been explained before.

Figure 4:
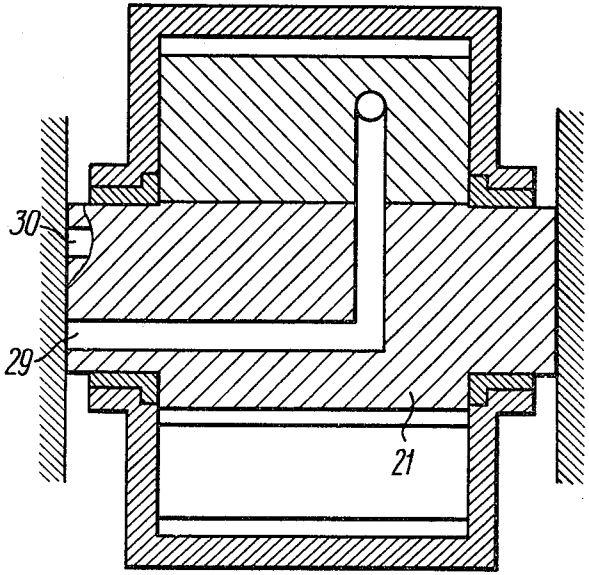
FIG. 4 is a section taken along the line IV—IV in FIG. 3.

The above-mentioned chambers communicate, respectively, through passageways 27 and 28 provided in the webs 23 and along passageways 29 (FIG. 4) and 30 made in the gear 21, with high- and low-pressure fluid sources.

The idle gears 24 are cylinder-shaped and are made of any elastic material. When the above-mentioned gears are mounted in the annular space between the toothings 20 and 22, they acquire a shape slightly flattened from the sides adjacent to the toothings 20 and 22. Such a shape contributes to a higher engagement factor of the mating gear toothings and, consequently, increases fluid-tightness of the chambers.

The first-described embodiment of the gear-type positive-displacement machine operates as follows.

When high-pressure fluid is fed through the passageways 15 into the chambers 10, 11, and the chambers also communicated through the passageways 16 with the low-pressure fluids supply source, each idle gear 9 is under an excess pressure exerted by the fluid-tight chambers 10, 11. Under the effect of the excess pressure, the idle gears 9 roll over the stationary toothing 2, thereby making the gear 3 rotate.

This being the case, the centre of each idle gear 9, when moving from one to the other extreme position (shown by dotted line in FIG. 1), describes an angle $\alpha$. Concurrently, the gear 3 rotates through an angle $\beta$ which can be derived from the following relationship.

$$\beta = 2\alpha(1 + (Z_1/Z_2)$$

where $Z_1$ = number of teeth in the idle gears 9;

$Z_2$ = number of teeth in the toothing 4.

Thus the angle $\beta$ of rotation of the output member, may be either less or greater than 360° and depends on the number of the webs 12 and on the geometry of the toothings of both the idle gears 9 and the gear 3.

The dead space of the fluid-tight chambers 10 and 11 primarily depend on the spaces confined within the idle gears 9 when in either of their extreme positions and the cylindrical portions of the surfaces 17 of the webs 12. The minimum volume of the dead spaces is attained by rolling the idle gears 9 over from one web to the other, i.e., throughout the entire stroke.

To return the gear 3 into the initial position (i.e., to reverse the machine) the passageways 15 are communicated with the low-pressure fluid supply source, whereas the passageways 16, with the high-pressure fluid supply source.

The gear-type machine carried into effect according to the second disclosed, preferred embodiment operates similarly, the sole difference being in that the angle $\beta_1$ of rotation of the output member, i.e., the housing 19, is derived from the following formula:

$$\beta_1 = 2\alpha_1(Z_3 + Z_4)/(2Z_3 + Z_4)$$

where:

$\alpha_1$ = angle of rotation of the centre of the idle gears 24;

$Z_3$ = number of teeth in the idle gears 24;

$Z_4$ = number of teeth in the toothing 22.

What we claim is:

1. A gear-type positive-displacement machine, comprising:

a housing having a row of inwardly directed teeth, a central gear in said housing, set coaxially to said housing, said central gear including a row of external outwardly directed teeth thereon;

two substantially cylindrically-shaped idle gears symmetrically spaced apart between said row of inwardly directed teeth of said housing and said row of outwardly directed teeth of said central gear, said idle gears including rows of gear teeth meshing and interengaging with the respective rows of teeth of said inwardly directed teeth of said housing and of said outwardly directed teeth of said central gear, said idle gears being mounted with freedom to roll over said outwardly directed teeth of said external teeth of the central gear and said teeth of said housing to impart relative rotation between said housing and said central gear;

said interengaging rows of teeth of the idle gears, the housing and the central gear, having respective spaces defined therebetween in said housing;

webs within said housing between said housing and said central gear and fixed with respect to either said housing or said central gear and permitting relative movement therebetween, said webs being spaced apart about said central gear and positioned in said spaces so as to define two fluid-tight chambers, said webs including peripheral portions facing said housing adapted for sealing engagement with said housing to make said chambers fluid-tight, said webs including lateral surfaces facing said idle gears;

said idle gears being made of an elastic material having a diameter slightly larger than the clearance between said housing and said central gear that upon assembly said idle gears are lightly compressed into a flattened shape to provide for greater engagement between the teeth of said idle gears and said housing and said external teeth of said central gear to increase fluid-tightness between opposite sides of said idle gears; and, fluid supply means forming part of said webs to define a passageway to supply working fluid to said fluid-tight chambers and to discharge the working fluid therefrom, said fluid supply means supplying the fluid through said lateral surfaces to the space between said lateral surfaces and said idle gears and to discharge fluid from the space between said lateral surfaces and said idle gears to impart rotation to said idle gears, said fluid supply means supplying fluid through and discharging fluid from said lateral surfaces to increase the volumetric efficiency of the gear-type machine.

2. The gear-type machine as defined in claim 1, wherein said lateral surfaces of said webs are portions of a cylindrical surface having a radius approximating that of the addendum circle of said idle gears so that said fluid-tight chambers have a minimum possible dead surface.

3. The gear type machine as set forth in claim 1, wherein the pattern of angular movements between said interengaging rows of teeth is defined by the formula $$\beta_1 = 2\alpha_1 (Z_3 + Z_4)/(2Z_3 + Z_4)$$

wherein:

$\beta_1$ is the angle through which said housing rotates,
$\alpha_1$ is the angle through which said idle gears rotate,
$Z_3$ is the number of teeth on said idle gears, and
$Z_4$ is the number of teeth on said central gear.

4. The gear type machine as set forth in claim 1, wherein said housing is stationary;
said central gear is rotatable; and,
said web being fixed with said housing, and said passageways in said web include portions cut-out from said lateral surface to provide a passage between the teeth of said idle gears and said lateral surface when said idle gears are adjacent to said lateral surface.

5. The gear type machine as set forth in claim 4, wherein the pattern of angular movements between said interengaging rows of teeth is defined by the formula $$\beta = 2\alpha (1 + (Z_1/Z_2)$$

wherein:

$\beta$ is the angle through which said central gear rotates,
$\alpha$ is the angle through which the idle gears rotate,
$Z_1$ is the number of teeth on said idle gears, and
$Z_2$ is the number of teeth on said central gear.

6. The gear type machine as defined in claim 1, wherein said housing is rotatable;
said central gear is stationary, said central gear including first passages;
said web being fixed with said central gear; and,
said passageways in said web include second passages which pass through said web and open into said fluid-tight chambers through openings in said lateral surface, said first and said second passages being in communication with each other to supply fluid through openings in said lateral surfaces directly to the cylindrical outer surface of said idle gears and to withdraw fluid through said openings in said lateral surfaces directly from the cylindrical outer surface of said idle gears.

7. The gear type machine as set forth in claim 6, wherein said idle gears are cylinder-shaped.

8. The gear type machine as set forth in claim 6, wherein the pattern of angular movements between said interengaging rows of teeth is defined by the formula $$\beta_1 = 2\alpha_1 (Z_3 + Z_4)/(2Z_3 + Z_4)$$

wherein:

$\beta_1$ is the angle through which said housing rotates,
$\alpha_1$ is the angle through which said idle gears rotate,
$Z_3$ is the number of teeth on said idle gears, and
$Z_4$ is the number of teeth on said central gear.

9. A gear-type positive-displacement machine, comprising:

a rotatable housing having a row of inwardly directed teeth, a stationary central gear in said housing set coaxially thereto, said central gear including a row of external outwardly directed teeth thereon;

two substantially cylindrically-shaped idle gears formed of elastic material symmetrically spaced apart between said row of inwardly directed teeth of said housing and said row of outwardly directed teeth of said central gear, said idle gears including rows of gear teeth meshing and interengaging with the respective rows of teeth of said inwardly directed teeth of said housing and of said outwardly directed teeth of said central gear, said idle gears being mounted with freedom to roll over said outwardly directed teeth of said external teeth of the central gear and said teeth of said housing to impart relative rotation between said housing and said central gear;

said idle gears being mounted in the annular space between said rotatable housing and said stationary central gear, the extent of said annular space between said housing and said central gear being less than the diameter of said idle gears;

said interengaging rows of teeth of the idle gears, the housing, and the central gear, having respective spaces defined therebetween in said housing;

webs within said housing between said housing and said central gear and fixed to said central gear and permitting relative movement between said housing and said central gear, said webs being spaced apart about said central gear and positioned in said spaces so as to define two fluid-tight chambers, said webs including peripheral portions facing said housing adapted for sealing engagement with said housing to make said chambers fluid-tight, said webs including lateral surfaces facing said idle gears;

said gears having a slightly flattened shape when mounted in said annular space to provide for increased fluid-tightness between said fluid-tight chambers; and, fluid supply means forming part of said webs to define a passageway to supply working fluid to said fluid-tight chambers and to discharge the working fluid therefrom, said fluid supply means supplying the fluid through said lateral surfaces to the space between said lateral surfaces and said idle gears and to discharge fluid from the space between said lateral surfaces and said idle gears to impart rotation to said idle gears, said fluid supply means supplying fluid through and discharging fluid from said lateral surfaces to increase the volumetric efficiency of the gear-type machine.

10. The gear type machine as defined in claim 9, wherein said central gear includes first passages; and said passageways in said web include second passages which pass through said web and open into said fluid-tight chambers through openings in said lateral surface, said first and said second passages being in communication with each other to supply fluid through openings in said lateral surfaces directly to the cylindrical outer surface of said idle gears and to withdraw fluid through said openings in said lateral surfaces directly from the cylindrical outer surface of said idle gears.

11. The gear type machine as set forth in claim 9, wherein the pattern of angular movements between said interengaging rows of teeth is defined by the formula $$\beta_1 = 2\alpha_1 (Z_3 + Z_4)/(2Z_3 + Z_4)$$

wherein:

$\beta_1$ is the angle through which said housing rotates, $\alpha_1$ is the angle through which said idle gears rotate, $Z_3$ is the number of teeth on said idle gears, and $Z_4$ is the number of teeth on said central gear.

12. A gear-type positive-displacement machine, comprising:

a stationary housing having a row of inwardly directed teeth, a rotatable central gear in said housing, set coaxially to said housing, said central gear including a row of external outwardly directed teeth thereon;

two substantially cylindrically-shaped idle gears formed of elastic material symmetrically spaced apart between said rows of inwardly directed teeth of said housing and said row of outwardly directed teeth to said central gear, said idle gears including rows of gear teeth meshing and interengaging with the respective rows of teeth of said inwardly directed teeth of said housing and of said outwardly directed teeth of said central gear, said idle gears being mounted with freedom to roll over said outwardly directed teeth of said external teeth of the central gear and said teeth of said housing to impart relative rotation between said housing and said central gear;

said interengaging rows of teeth of the idle gears, the housing and the central gear, having respective spaces defined therebetween in said housing;

webs within said housing between said housing and said central gear and fixed with respect to said housing and permitting relative movement between said housing and said central gear, said webs being spaced apart about said central gear and positioned in said spaces so as to define two fluid-tight chambers, said webs including peripheral portions facing said housing adapted for sealing engagement with said housing to make said chambers fluid-tight, said webs including lateral surfaces facing said idle gears; said gears having a slightly flattened shape when mounted in the space between the housing and the central gear to provide for increased fluid-tightness between said fluid-tight chambers;

fluid supply means forming part of said webs to define a passageway to supply working fluid to said fluid-tight chambers and to discharge the working fluid therefrom, said fluid supply means supplying the fluid through said lateral surfaces to the space between said lateral surfaces and said idle gears and to discharge fluid from the space between said lateral surfaces and said idle gear to impart rotation to said idle gears, said fluid supply means supplying fluid through and discharging fluid from said lateral surfaces to increase the volumetric efficiency of the gear-type machine; and said passageways in said web include portions cut-out from said lateral surface to provide a passage between the teeth of said idle gears and said lateral surface when said idle gear is adjacent to said lateral surface.

13. The gear type machine as set forth in claim 12, wherein the pattern of angular movements between said interengaging rows of teeth is defined by the formula $$\beta = 2\alpha (1 + Z_1/Z_2)$$

wherein:

$\beta$ is the angle through which said central gear rotates, $\alpha$ is the angle through which the idle gears rotate, $Z_1$ is the number of teeth on said idle gears, and $Z_2$ is the number of teeth on said central gear.

* * * * *